United States Patent [19]

Berg

[11] 4,021,023

[45] May 3, 1977

[54] AUTOMATIC AGITATOR FOR FILM DEVELOPMENT

[76] Inventor: Joseph A. Berg, 41 A Troy Drive, Springfield, N.J. 07081

[22] Filed: Sept. 29, 1975

[21] Appl. No.: 617,937

[52] U.S. Cl. ..... 259/73

[51] Int. Cl.[2] ..... B01F 11/00

[58] Field of Search ..... 259/72, 73; 123/32 AE; 200/24, 23, 211 G, 211 TW, 211 K, 11 K, 11 TW

[56] References Cited

UNITED STATES PATENTS

| | | | |
|---|---|---|---|
| 108,297 | 10/1870 | Saggan | 259/73 |
| 734,693 | 7/1903 | Fraley | 259/73 |
| 3,189,697 | 6/1965 | Holzer | 200/23 |
| 3,531,603 | 9/1970 | Ashman | 200/11 TW |
| 3,546,403 | 12/1970 | Taesler | 200/24 |
| 3,790,347 | 2/1974 | Fletcher | 259/72 |
| 3,804,379 | 4/1974 | Merz | 259/73 |

*Primary Examiner*—Richard E. Aegerter
*Assistant Examiner*—L. Footland
*Attorney, Agent, or Firm*—Richard L. Miller

[57] ABSTRACT

A film developing tank support plate is provided on a main housing, which support plate is pivotally mounted to agitate the development tank in response to a control unit in the main housing. The control unit has a solenoid whose arm is connected to the support plate and is actuated by a rotating contact abutting stationary contacts on a stationary plate.

2 Claims, 3 Drawing Figures

AUTOMATIC AGITATOR FOR FILM DEVELOPMENT

BACKGROUND OF THE INVENTION

The present invention is directed to an automatic agitator for a film developing tank. In the development of exposed film, silver halides are converted into metallic silver which are fixed by using "hypo", the "hypo" removing the unused, unexposed silver salts.

In the developing process, the developing tank must be agitated at certain time intervals, which are typically 30 seconds for a small developing tank, and 1 minute for a large developing tank. This agitation is necessary to assure even development of the film and the dislodging of the air bubbles adhering to the film.

The agitation of the film while being developed has hitherto been accomplished manually with the person developing the film either shaking the developing tank at prescribed time intervals, or rotating an agitator rod which rotates a reel around which the film is wound and inserted in the developing tank.

SUMMARY OF THE INVENTION

It is the prime object of the present invention to provide an apparatus that will agitate film being developed without the person developing the film needing to manually agitate. To this end, the apparatus of the present invention is provided with a main housing which mounts an electric motor, which through a rotating contact engaging at specific time intervals fixed contacts, will allow for an arm of a solenoid activated in response to the rotating contact abutting a fixed contact to extend upwardly and pivot, or shake, a recessed support plate supporting a film developing tank.

The apparatus of the present invention is fully automatic and has means for adjusting the number of times a minute the arm of the solenoid is extended to shake the film developing tank.

BRIEF DESCRIPTION OF THE DRAWING

The invention will be more readily understood by the following detailed description, when taken in conjunction with the accompanying drawings, wherein.

DETAILED DESCRIPTION OF THE INVENTION

Figure 1:
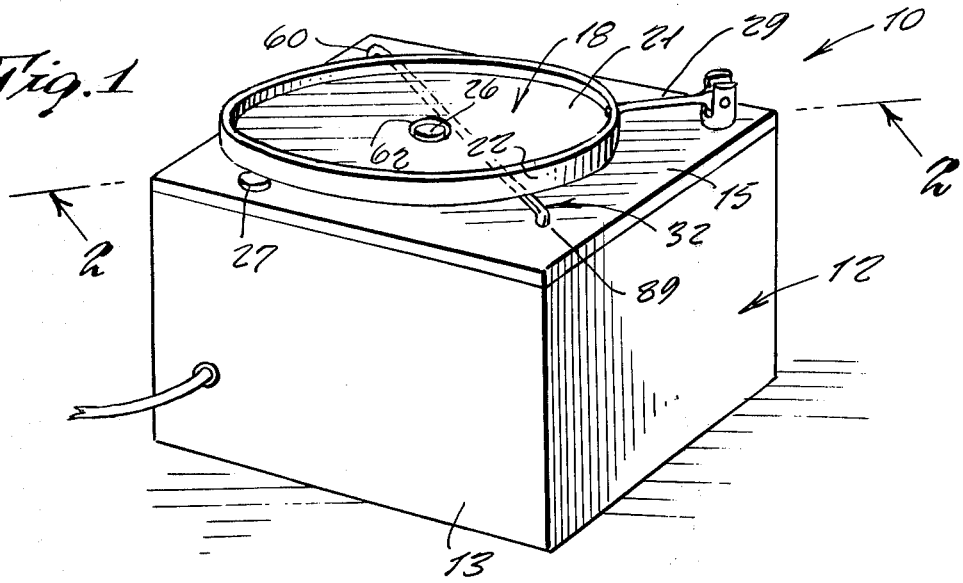
FIG. 1 is a perspective view of the automatic agitator of the present invention.

Referring now to the drawings, the automatic agitator of the present invention is generally indicated by numeral 10. The automatic agitator has a main housing 12 of cubic shape, and has four side walls 13, a bottom portion 14, and a top cover portion 15. The cover portion 15 may be attached to the side walls 13 in any conventional manner, such as by screws or the like, so that access to the interior of the housing may be possible. Mounted on the cover portion 15 is a film developing tank support plate 18 which is circular in shape to conform to the shape of a film developing tank 20 shown in phantom in FIG. 2. The support plate 18 has a bottom portion 21 with a circumferential wall 22 extending upwardly therefrom. The circumferential wall 22 forms a recessed chamber with the bottom portion 21 that will hold a film developing tank therein while it is agitated by the apparatus of the present invention.

The support plate 18 is pivotally supported on the cover portion 15 of the main housing 12. An opening 25 formed in the cover portion 15, centrally thereof, has secured by suitable manner therein a positioning pin 26. Positioning pin 26 is received in an opening 62 in the bottom side of support plate 18 with sufficient clearance so as not to interfere with the pivoting motion of support plate to be described later on. A pivot bar 32 rests on cover portion 15 as is better seen in sectional view of FIG. 2. The ends of pivot bar 32 are anchored at 89 and similarly at 60 to cover portion by an suitable conventional securing methods. In actuality, the weight of support plate 18 and container 20 is almost balanced upon pivot bar 32.

A mechanical stop 27 is also secured to cover portion 15 by adjustable screw 28 or other suitable adjustable securing methods so that the angle through which support plate 18 pivots may be varied to cause the agitation to be violent or gentle. This mechanical stop 27 supports the rest of the weight of support plate 18 and container 20 which is not supported by pivot bar 32.

Figure 2:
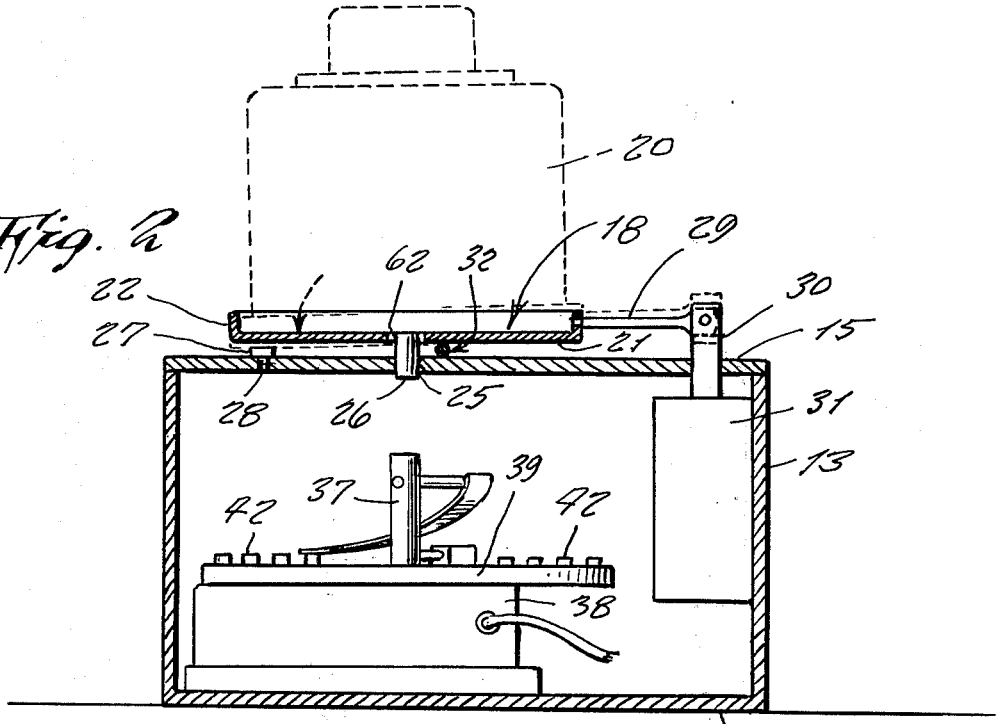
FIG. 2 is a cross-sectional view taken along line 2—2 of FIG. 1.

An arm 29 firmly connected to the support plate 18 in any conventional manner is connected to the top of a reciprocating solenoid arm 30. A solenoid 31 controlling the movement of the arms 29 and 30 is mounted to one side wall 13, the arm 30 extending out from the main housing and cover portiom through an opening, formed therein. As the solenoid arm 30 is reciprocated within the solenoid 31, the arm 29 will lower the support plate 18 at one end thereof thereby pivoting the entire support plate about the pivot bar 32. As seen in FIG. 2, when the arms 29 and 30 are moved to the position shown in dotted lines, the right half of the support plate will be lifted therewith. The left half of the support plate will naturally take a position that is lower than its original position shown in solid lines, its movement being limited by the mechanical stop 27. The support plate 18 therefore pivots about an axis extending along the longitudinal axis of the pivot bar 32. Arms 29 and 30 are in their lower position (shown in solid lines) when solenoid 31 is energized, and right half of the support plate will be lowered therewith, while the left half will be lifted from mechanical stop 27. Therefore, as the solenoid reciprocates the arms 29 and 30, the support plate 18 will oscillate about the pivot bar 32 to agitate the developing tank 20 thereon.

To further clarify the operation of this device, it should be understood that when the solenoid is energized, the support plate pivots clockwise as shown in FIG. 2 until the solenoid reaches its mechanical restraints. When the solenoid is de-energized the support plate pivots back to its rest position under the bias of gravitional forces so that bottom portion 21 of support plate 18 rests on mechanical stop 27. This rest position comes about because the entire pivoting assembly i.e. (support plate, container, solenoid, etc.,) has been designed to have it's center of gravity to the left of pivot bar 32 in FIG. 2.

Figure 3:
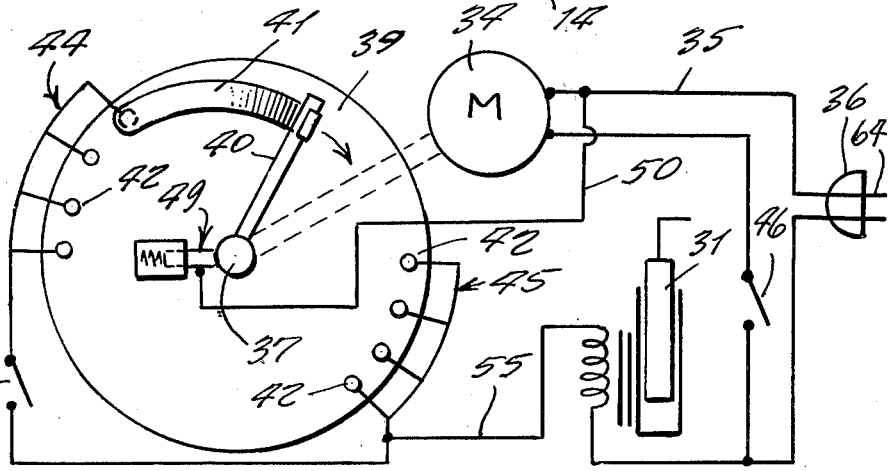
FIG. 3 is a schematic showing of the electric control circuit of the present invention.

The solenoid 31 which controls the movement of the arms 29 and 30, is activated at specific time intervals to agitate the developing tank on the support plate 18. Referring to FIG. 3, the solenoid is actuated in response to a control circuit which is made up of a drive motor 34 connected by conductor 35 to a plug 36, which is connectable to a power source (not shown). The shaft of the motor 34 is connected to a rotatable shaft 37 by gears or any other conventional means. The rotatable shaft 37, which is rotatably mounted in the motor housing 38, is surrounded by a non-rotating plate 39. Extending from the rotatable shaft 37 is a support arm 40 to which is supported a movable contact arm 41. The movable contact arm 41, which has a contact at its end thereof, intermittently contacts fixed contacts 42 provided on the plate 39. While contacts 42 have been shown as raised from the surface of the plate 39, it is to be understood that these contacts may be molded flush with the top surface of the plate 39.

As the contact arm 41 is rotated in the clockwise direction as viewed in FIG. 3, a circuit is completed which will energize the solenoid 31.

Two switches 46 and 47 are provided, the first switch 46 being connected between the drive motor 34 and a contact 64 of plug 36 while the second switch 47 is connected between the contacts 42 in the set of contacts referred to generally as 44 and a second set of contacts referred to generally as 45. A stationary brush contact 49 completes the circuit by connecting the conductor 35 via conductor 50 with the movable contact arm 41.

The operation of the device will now be described. After a developing tank has been placed on the plate 18, the switch 46 is closed which will supply current to the motor 34, thereby rotating hte arms 40, 41 in a clockwise direction as viewed in FIG. 3. As the movable contact arm 41 passes by the contacts 42 in the set of contacts referred to generally as 45, the contact at the end of the arm 41 will contact the contacts 42 to thereby complete a circuit supplying current to the solenoid 31. The current passes from the plug 36, through the conductors 35, 50 to contacts 49, 41 and 42 finally through the conductor 55, to solenoid 31, thereby actuating the solenoid 31 to reciprocate the arms 29 and 30 to agitate the tank 20.

When only the first switch 46 is closed, the set of contacts 45 are operative, while the set of contacts 44 are not, since current will not pass through the open switch 47. In this condition, the solenoid will reciprocate the arms 29 and 30 and agitate the tank 20 about once a minute, the agitation consisting of four oscillations or strokes spaced one second apart. The spacing of the oscillations are achieved by the spacing of the contacts 42 in the set 45 from each other, although it will be understood that different contact spacing and different oscillation spacings may be provided.

If more than one agitation per minute is desired, the second switch 47 is closed, thereby completing a circuit for the contacts 42 in the set 44. In FIG. 3, when the switches 46 and 47 are both in the closed position, there will be agitation of the developing tank every thirty seconds, each agitation consisting of four one second oscillations or strokes of the arms 29 and 30. It will be understood that numerous other combinations may be achieved simply by controlling the rotation of the motor 34 and arms 40, 41 by the spacings of the contacts 42, and by the addition of more or less than four contacts 42 in a set.

While a specific embodiment of the invention has been shown and described, it is to be understood that numerous changes and modifications may be made without departing from the scope of the present invention.

What is claimed is:

1. An automatic agitator for agitating a film developing tank for film development, comprising: a main housing having four side walls, a bottom portion, and a top removable cover portion: a developing tank support plate for supporting said developing tank thereon; means for pivotally mounting said support plate to said top cover portion; means connected to said support plate for oscillating said support plate and developing tank thereon; limit means mounted on said top cover portion near one end of said support plate for limiting the downward movement of said one end; and control means for controlling the movement of said means for oscillating said support plate; said means for oscillating said support plate comprising a solenoid mounted in one of said side walls, and an arm connected to said solenoid and the other end of said support plate; said means for pivotally mounting said support plate to said top cover portion comprising a pivot bar secured to said top cover portion remote from the central diameter thereof toward said other end of said support plate, a positioning pin secured to said top cover portion, said support plate having a central opening to receive said positioning pin with sufficient clearance so that said support plate may freely pivot when acted upon by the force supplied by said solenoid and gravity; said control means comprising a motor, a housing for said motor, a stationary plate mounted above said housing, said stationary plate having a plurality of contacts thereon, and rotating contact means mounted above said stationary plate for intermittently contacting said plurality of contacts to actuate said solenoid to agitate the film developing tank, said rotating contact means comprising a rotatable shaft mounted in said stationary plate, a first arm extending radially from said rotatable shaft, and a second arm connected to said first arm having a contact at the end thereof for contacting said plurality of contacts, said plurality of contacts comprising a first set of contacts and a second set of contacts, said first and second sets of contacts being spaced circumferentially from each other on said stationary plate, said control means further comprising a first switch and a second switch, said first switch connected between said motor and a conventional power source, and said second switch being connected between said first set of contacts and said second set of contacts, said first and second sets of contacts being electrically connected to said solenoid, whereby opening said second switch will deactivate said second set of contacts, said rotating contact means being electrically connected in series with said solenoid and a conventional power source.

2. The automatic agitator according to claim 1, wherein each of said first and second sets of contacts comprises four contacts.

* * * * *